US006904688B1

(12) United States Patent
Henry

(10) Patent No.: US 6,904,688 B1
(45) Date of Patent: Jun. 14, 2005

(54) SIGHT PROTECTIVE COVER SYSTEM

(76) Inventor: Donald J. Henry, Box 28, Rte. 220, New Albany, PA (US) 18833

( * ) Notice: Subject to any disclaimer, the term of this patent is extended or adjusted under 35 U.S.C. 154(b) by 0 days.

(21) Appl. No.: 10/707,830

(22) Filed: Jan. 15, 2004

(51) Int. Cl.[7] ..... F41G 1/467

(52) U.S. Cl. ..... 33/265; 33/334; 124/87; 42/123; 42/131; 42/132

(58) Field of Search ..... 33/265, 334; 42/113, 42/115, 123, 131, 132; 124/87

(56) References Cited

U.S. PATENT DOCUMENTS 3,997,974 A * 12/1976 Larson ..... 33/265
4,638,565 A * 1/1987 Podany et al. ..... 33/265
5,127,166 A * 7/1992 Bishop ..... 33/265
5,249,002 A * 9/1993 Chou et al. ..... 351/158
5,274,928 A * 1/1994 Arnt ..... 33/352
5,359,779 A * 11/1994 Polk et al. ..... 42/115
5,434,704 A * 7/1995 Connors et al. ..... 42/113
5,669,703 A * 9/1997 Wheeler et al. ..... 362/249
5,697,357 A * 12/1997 Chipman ..... 124/87
5,850,700 A * 12/1998 Capson et al. ..... 33/265
6,016,608 A * 1/2000 Lorocco ..... 33/265
6,477,778 B1 * 11/2002 Lorocco ..... 33/265
6,601,308 B2 * 8/2003 Khoshnood ..... 33/265
6,701,632 B2 * 3/2004 Henry ..... 33/265

* cited by examiner

*Primary Examiner*—Christopher W. Fulton
*Assistant Examiner*—Yaritza Guadalupe
(74) *Attorney, Agent, or Firm*—John J. Elnitski, Jr.

(57) ABSTRACT

A sight protective cover system adapted for a target sight including a protective cover. The protective cover being a body having at least two L-shaped slots. Also, including a mounting section which has a protective cover insert extending outward from the mounting section and away from the target sight, where the protective cover insert is sized to fit inside the body of the protective cover. There are at least two studs extending from the protective cover insert to interact with the at least two L-shaped slots to lock the mounting section and the protective cover together. There is a spring member between the mounting section and the protective cover to provide tension between the at least two studs and the at least two L-shaped slots to aid in locking the mounting section and the protective cover together.

20 Claims, 7 Drawing Sheets

SIGHT PROTECTIVE COVER SYSTEM

BACKGROUND OF INVENTION

The present invention generally relates to covers for protecting target sights. More specifically, the present invention relates to a cover to protect a target sight of an archery bow.

It is know to have target sights mounted to an archery bow. The target sight is usually a sight surrounded by a open circular body. The circular body is usually attached to a mount which connects the circular body to the archery bow. There are protective covers on the market which attach to the circular body to protect the fragile components of the sight. Most of these protective covers thread into the circular body. The problem with the current protective covers is that the threads of the protective cover and circular body are fine. Archers remove and reinstalled the protective cover on many occasions and it is very easy to strip or cross-thread the fine threads. What is needed is a system which allows removal and reinstallation of the protective cover with out the use of threads.

It is an object of the present invention to provide a system which allows removal and reinstallation of a protective cover on a target sight with out the use of threads.

SUMMARY OF INVENTION

A sight protective cover system adapted for a target sight including a protective cover. The protective cover being a body having at least two L-shaped slots. Also, including a mounting section which has a protective cover insert extending outward from the mounting section and away from the target sight, where the protective cover insert is sized to fit inside the body of the protective cover. There are at least two studs extending from the protective cover insert to interact with the at least two L-shaped slots to lock the mounting section and the protective cover together. There is a spring member between the mounting section and the protective cover to provide tension between the at least two studs and the at least two L-shaped slots to aid in locking the mounting section and the protective cover together.

DETAILED DESCRIPTION

Figure 1:
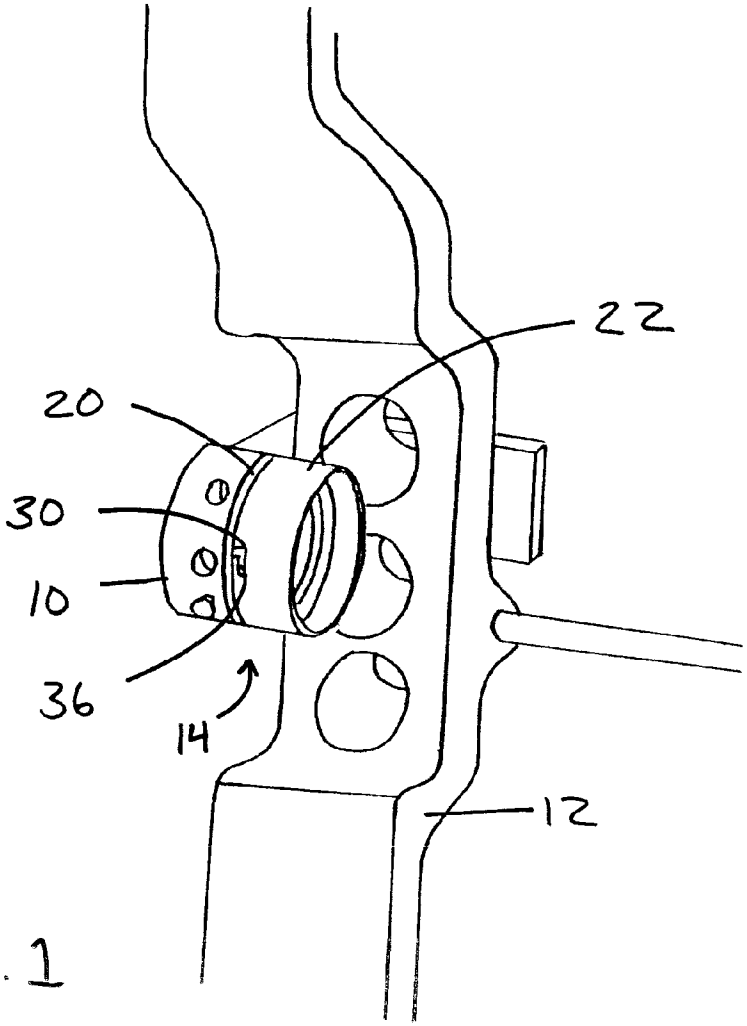
FIG. 1 is a perspective view of a sight protective cover system according to the present invention.
Figure 2:
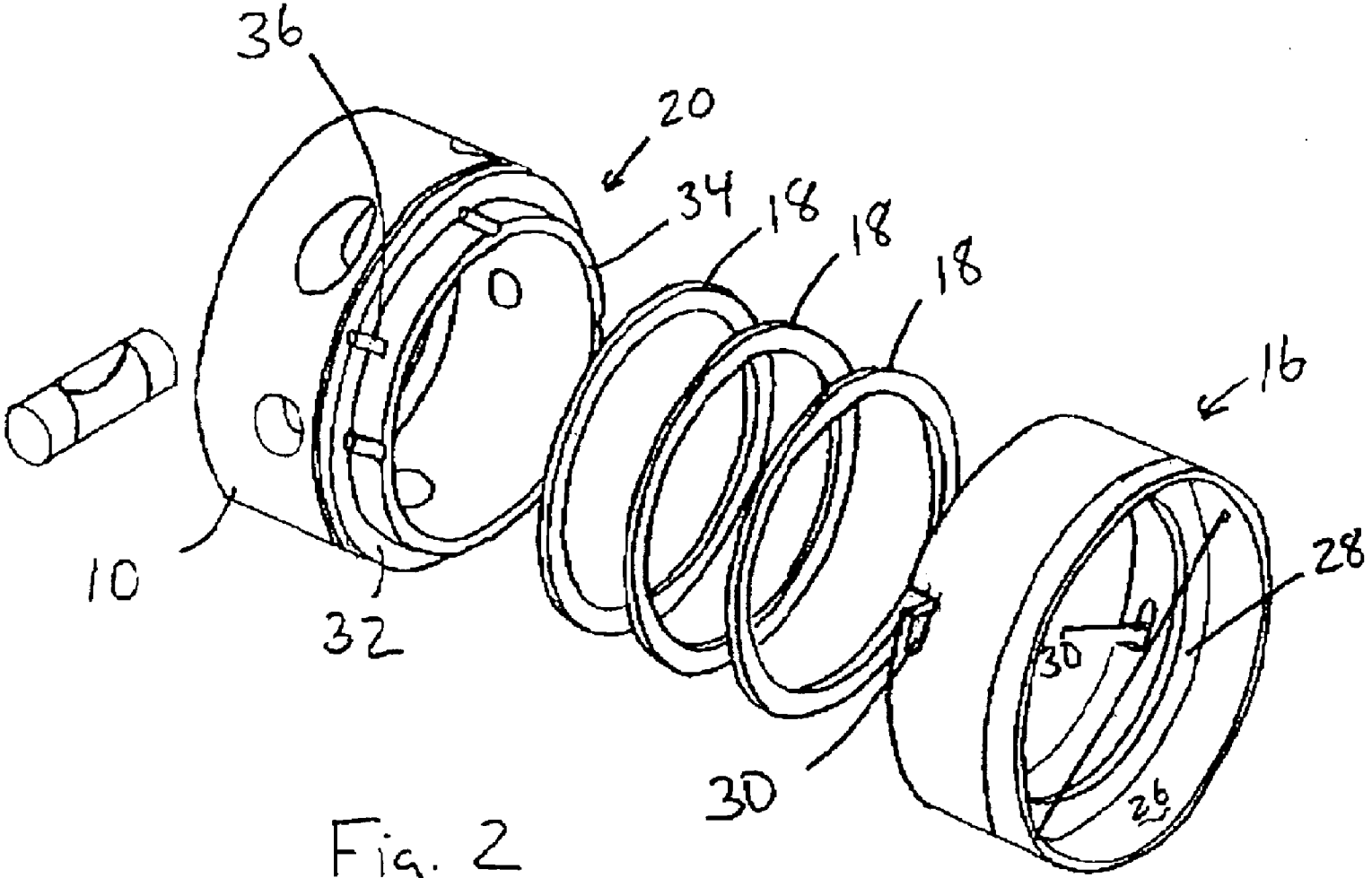
FIG. 2 is a perspective exploded view of a sight protective cover system according to the present invention.
Figure 3:
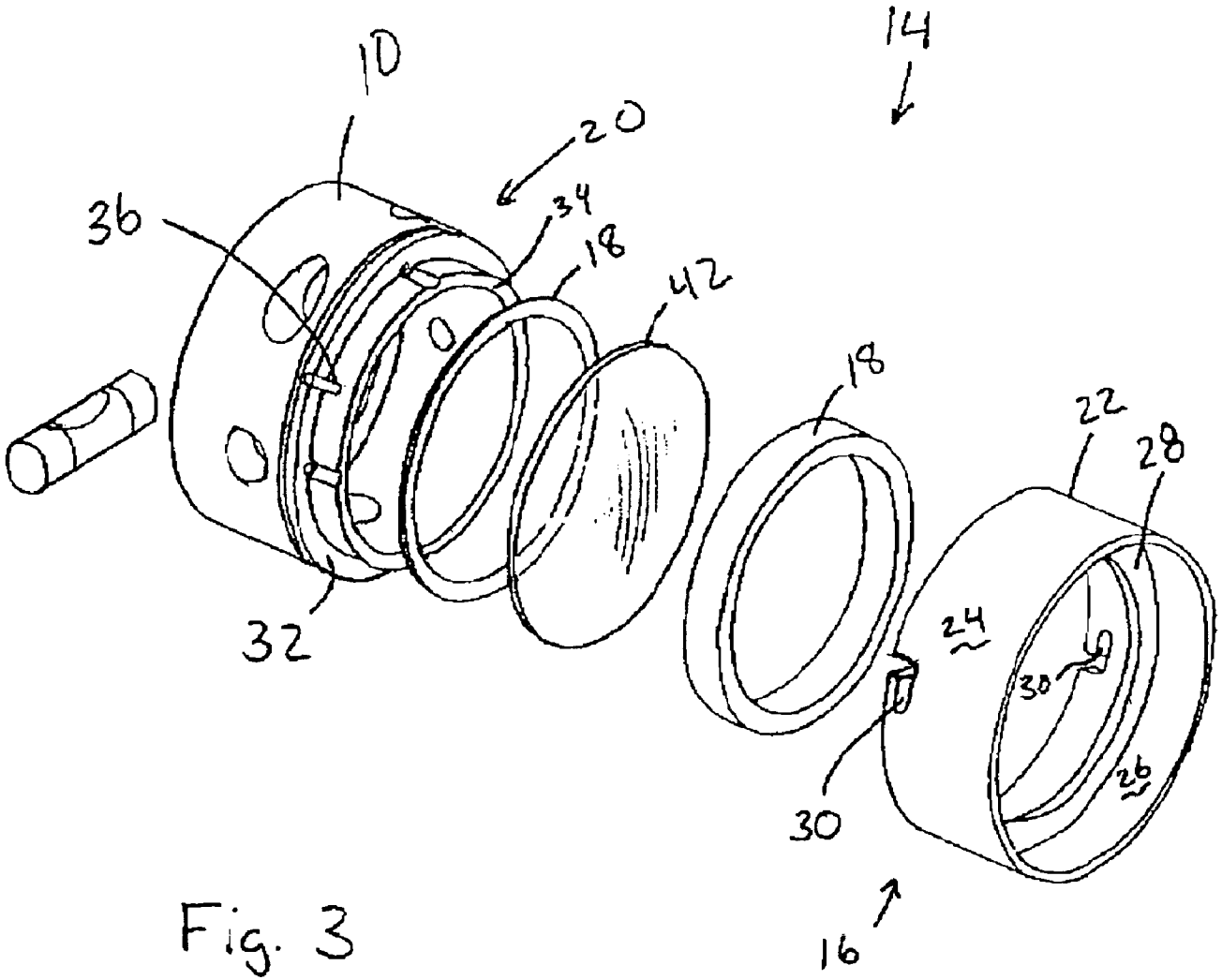
FIG. 3 is a perspective exploded view of a sight protective cover system according to the present invention.
Figure 4:
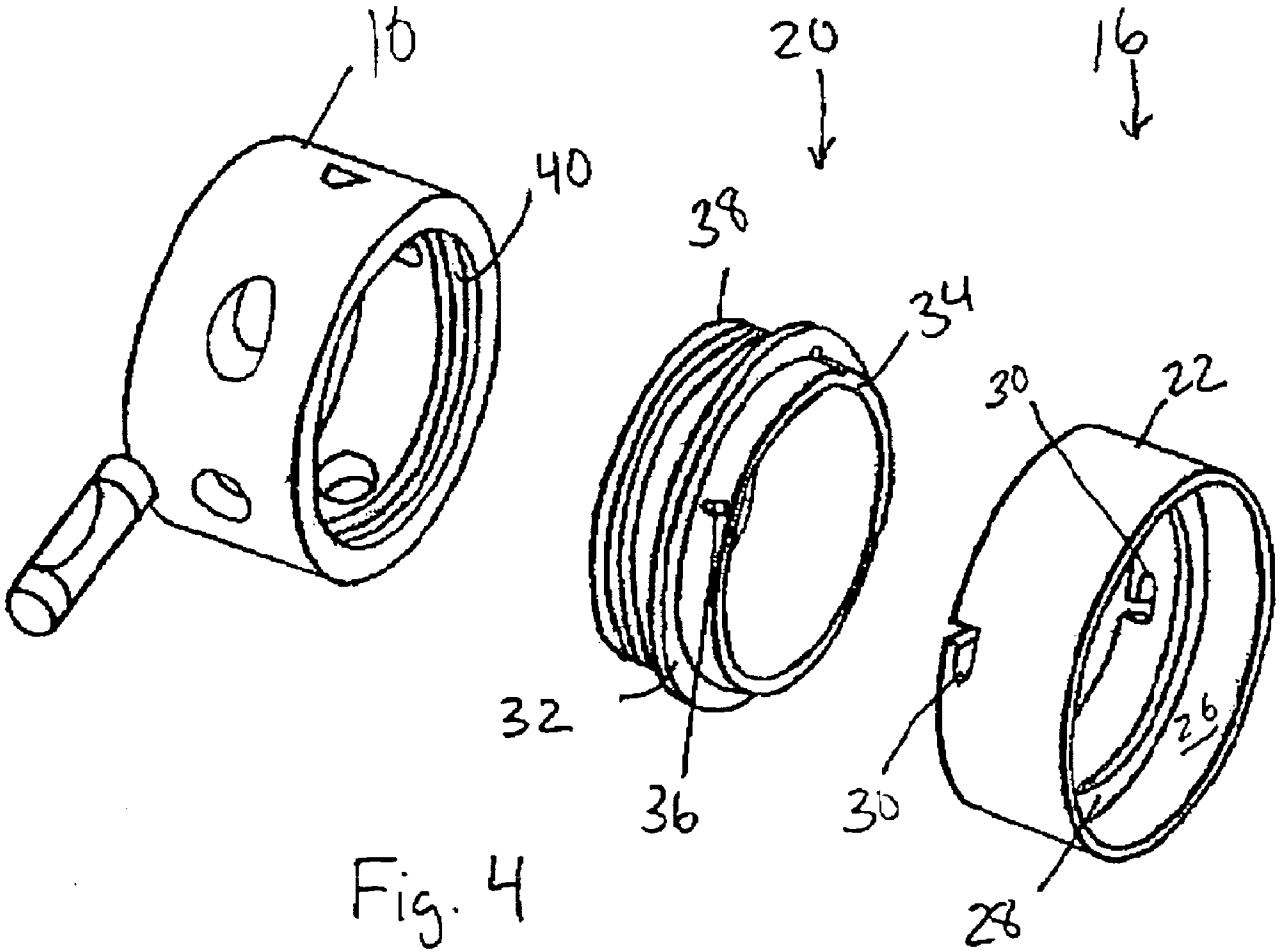
FIG. 4 is a perspective exploded view of a sight protective cover system according to the present invention.

The present invention is a sight protective cover system. FIG. 1 shows a target sight 10 attached to an archery bow 12 with the sight protective cover system 14. A protective cover 16 is shown attached to the target sight 10 in FIG. 1. FIGS. 2–4 show three configurations of the sight protective cover system 14. All configurations include at least one rubber gasket 18, a protective cover 16, and mounting section 20. The protective cover 16 is shown as an open cylinder shape body 22 having a front and rear. The open shape of the body 22 does not have to be a cylinder. The body 22 of the protective cover 16 includes an exterior surface 24 and interior surface 26. A stop 28 is formed inside the protective cover 16 along the interior surface 26. The body 22 includes two L-shaped slots 30 opposing each other. The mounting section 20 includes a circular flat face 32 and a protective cover insert 34 extending outward from the circular flat face 32. The protective cover insert 34 includes two studs 36 extending outward from the protective cover insert 34.

FIGS. 2 and 3 show the mounting section 20 formed as an integral part of the target sight 10. FIG. 4 shows the mounting section 20 as a separate component which mounts to the target sight 10. FIG. 4 shows the mounting section 20 having a threaded male end 38 and the target slight 10 with a threaded female end 40. The fine threaded male end 38 is an attachment configuration of the mounting section 20, whereby the threaded male end 38 is just an example of different possible attachment configurations. The mounting section 20 is attached to the target sight 10 by threading the threaded male end 38 of the mounting section 20 into the threaded female end 40 of the target sight 10. The mating of the target sight 10 and the mounting section 20 can be done by any known means, whereby FIG. 4 is just an example of a threaded configuration. This makes the sight protective cover system 14 versatile. The separate mounting section 20 of FIG. 4 can be used with existing target sights that have the ability to have the mounting section 20 attached to the target sight 10 by creating the appropriate attachment configuration on the mounting section 20 which matches the attachment configuration of the target sight 10. FIG. 2 shows three rubber gaskets 18 between the mounting section 20 and the protective cover 16. FIG. 3 shows two rubber gaskets 18 and a protective lens 42 between the mounting section 20 and the protective cover 16.

Figure 5:
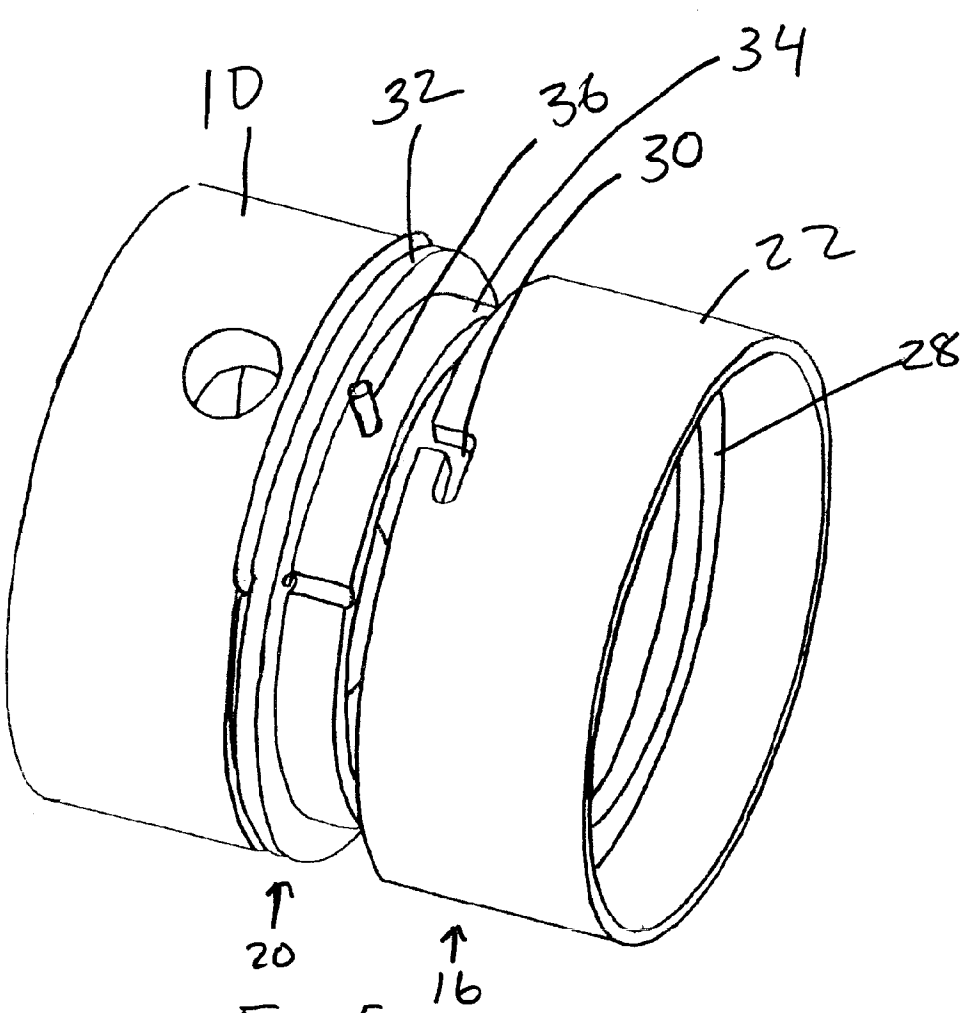
FIG. 5 is a perspective assembly view of a sight protective cover system according to the present invention.
Figure 6:
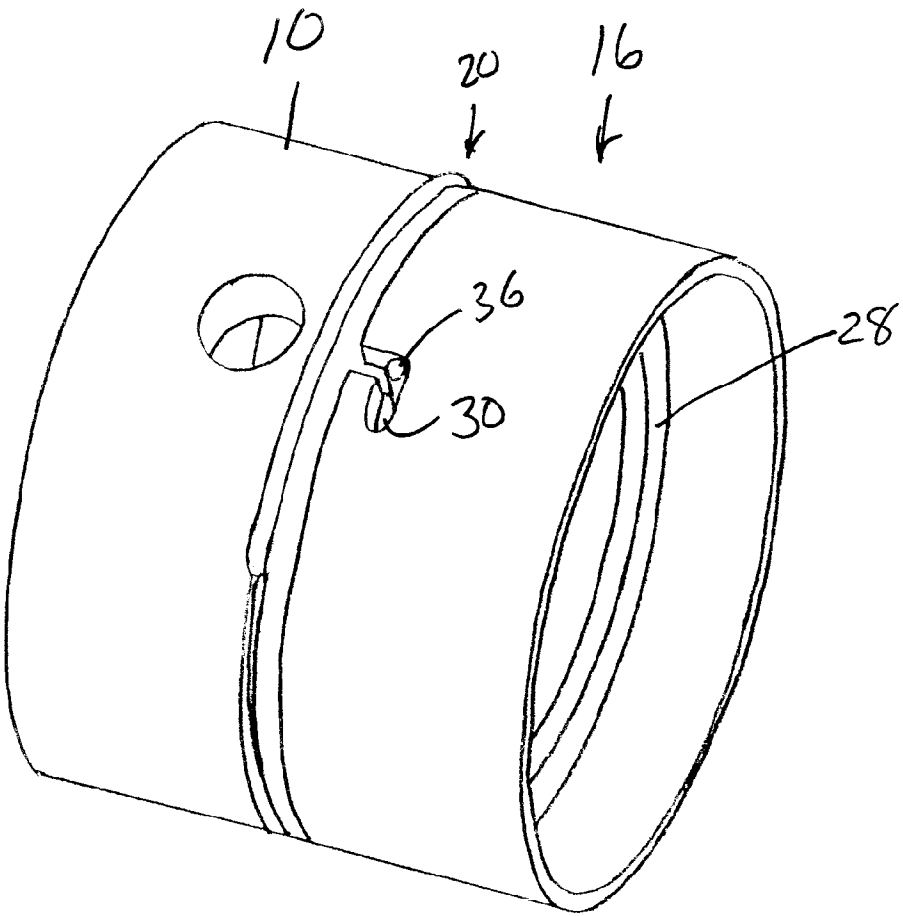
FIG. 6 is a perspective assembly view of a sight protective cover system according to the present invention.
Figure 7:
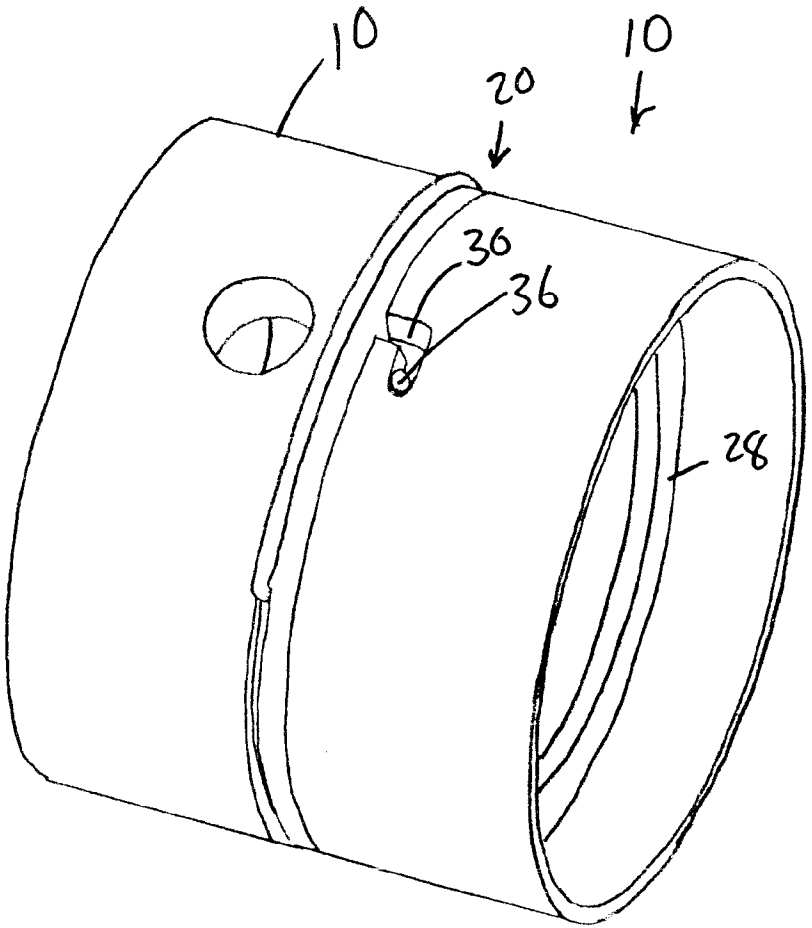
FIG. 7 is a perspective assembly view of a sight protective cover system according to the present invention.

The following is the assembly and use of the sight protective cover system 14. FIG. 5 shows the protective cover 16 aligned for insertion of the protective cover insert 34 of the mounting section 20 into the protective cover 16. Note, the L-shaped slot 30 is aligned to receive the stud 36 of the mounting section 20. FIG. 6 shows the protective cover insert 34 of the mounting section 20 inserted into the protective cover 20, such that stud 36 is near the change of direction of the L-shaped slot 30. FIG. 7 shows the position of the stud 36 in the L-shaped slot 30, after the protective cover 16 has been twisted clockwise to lock the protective cover 16 and mounting section 20 together. The rubber gaskets 18 act as a spring member and require the protective cover 16 be pressed against the mounting section 20 in order to twist and lock the protective cover 16 in place. Once the protective cover 16 is twisted, there is a natural tension between the L-shaped slots 30 and studs 36 which locks the protective cover 16 in place. One gasket 18 can be used, but multiple gaskets 18 improve the flexibility of the gaskets 18 acting as the spring member. There can be other materials or device used in place of the rubber gaskets 18, as long as the replacement provides a similar spring action. In all configurations of the sight protective cover system 14, the protective cover 16 acts as a hood to protect the workings of the target sight 10. In the case of FIG. 3, there is the additional protection of the lens 42.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A sight protective cover system adapted for a target sight, comprising:

a protective cover, said protective cover being an open shaped body, said body having at least two L-shaped slots;

a mounting section adapted to extend from the target sight, said mounting section including a protective cover insert extending outward from said mounting section and away from the target sight, said protective cover insert sized to fit inside said body of said protective cover;

at least two studs extending from said protective cover insert to interact with said at least two L-shaped slots to lock said mounting section and said protective cover together; and a spring member between said mounting section and said protective cover to provide tension between said at least two studs and said at least two L-shaped slots to aid in locking said mounting section and said protective cover together.

2. The sight protective cover system of claim 1, wherein said mounting section is an integral part of the target sight.

3. The sight protective cover system of claim 1, wherein said mounting section is a separate part which attaches to the target sight.

4. The sight protective cover system of claim 3, wherein said mounting section includes threads to thread to the target sight.

5. The sight protective cover system of claim 3, wherein said spring member is at least one flexible gasket and further including a stop within said open shaped body of said protective cover to provide a solid surface against said at least one flexible gasket.

6. The sight protective cover system of claim 5, wherein said sight protective cover is adapted to work with an archery bow target sight.

7. The sight protective cover system of claim 3, wherein said spring member is at least two flexible gaskets and further including stop within said open shaped body of said protective cover to provide a solid surface against said at least two flexible gaskets.

8. The sight protective cover system of claim 7, further including a lens between said at least two flexible gaskets.

9. The sight protective cover system of claim 8, wherein said sight protective cover is adapted to work with an archery bow target sight.

10. The sight protective cover system of claim 7, wherein said sight protective cover is adapted to work with an archery bow target sight.

11. The sight protective cover system of claim 3, wherein said sight protective cover is adapted to work with an archery bow target sight.

12. The sight protective cover system of claim 1, wherein said spring member is at least one flexible gasket and further including a stop within said open shaped body of said protective cover to provide a solid surface against said at least one flexible gasket.

13. The sight protective cover system of claim 12, wherein said sight protective cover is adapted to work with an archery bow target sight.

14. The sight protective cover system of claim 1, wherein said spring member is at least two flexible gaskets and further including stop within said open shaped body of said protective cover to provide a solid surface against said at least two flexible gaskets.

15. The sight protective cover system of claim 14, further including a lens between said at least two flexible gaskets.

16. The sight protective cover system of claim 14, wherein said sight protective cover is adapted to work with an archery bow target sight.

17. The sight protective cover system of claim 1, further including a lens between said mounting section and said protective cover.

18. The sight protective cover system of claim 1, wherein said sight protective cover is adapted to work with an archery bow target sight.

19. A sight protective cover system adapted for a target sight, comprising:

a protective cover, said protective cover being an open shaped body;

a mounting section adapted to extend from the target sight, said mounting section including a protective cover insert extending outward from said mounting section and away from the target sight, said protective cover insert sized to fit inside said body of said protective cover;

a locking device to lock said protective cover and said mounting section together; and a spring member between said mounting section and said protective cover to provide tension to aid in locking said mounting section and said protective cover together.

20. The sight protective cover system of claim 19, wherein said sight protective cover is adapted to work with an archery bow target sight.

* * * * *